United States Patent [19]

Mauffette

[11] Patent Number: 5,011,054

[45] Date of Patent: Apr. 30, 1991

[54] TAMPER PROOF HANGER WITH IMPROVED RATCHET ARM IN LOCK

[75] Inventor: Claude Mauffette, Montreal, Canada

[73] Assignee: Quada Internationale Ltd., Québec, Canada

[21] Appl. No.: 485,527

[22] Filed: Feb. 27, 1990

[51] Int. Cl.[5] ..... A47G 25/30; A47G 25/14

[52] U.S. Cl. ..... 223/88; 223/91; 223/93; 223/92; 223/85

[58] Field of Search ..... 223/85, 88, 90, 92, 223/93, 91, 94; 70/369, 370, 57, 59; 211/113

[56] References Cited

U.S. PATENT DOCUMENTS

| | | | |
|---|---|---|---|
| 2,490,590 | 12/1949 | Glavies | 223/88 |
| 4,324,352 | 4/1982 | Goldfarb et al. | 223/93 |
| 4,615,447 | 10/1986 | Walter | 70/59 |
| 4,672,827 | 6/1987 | Craig | 70/369 |
| 4,712,400 | 12/1987 | Steinbach | 70/369 |
| 4,951,484 | 8/1990 | Rohald | 223/85 |

FOREIGN PATENT DOCUMENTS

| | | | |
|---|---|---|---|
| 644526 | 10/1928 | France | 223/93 |

*Primary Examiner*—Werner H. Schroeder
*Assistant Examiner*—Bibhu Mohanty
*Attorney, Agent, or Firm*—Robic

[57] ABSTRACT

A key-operable combination for use in a tamper-proof garment hanger, which combination is very simple yet efficient in structure and is capable of cooperation with a rack forming part of a garment gripping member for selectively holding the gripping member into and out of locking position. This key-operable combination comprises a cylinder lock comprising an outer lock cylinder solid with the larger casing and a key-operable rotary lock barrel mounted within the outer cylinder. An operating member is rotatably mounted on the outer lock cylinder, within the casing, this operating member and the lock barrel being coupled together for allowing rotation of the operating member when the lock barrel is key-operated into rotation. A pawl radially projects from the operating member. This pawl has a free end operatively engaging the rack of the gripping member. Finally, a resilient lever is provided which radially projects from the rotary operating member and has a free end which is resiliently applied against the inner wall of the casing to press the pawl against the rack.

4 Claims, 4 Drawing Sheets

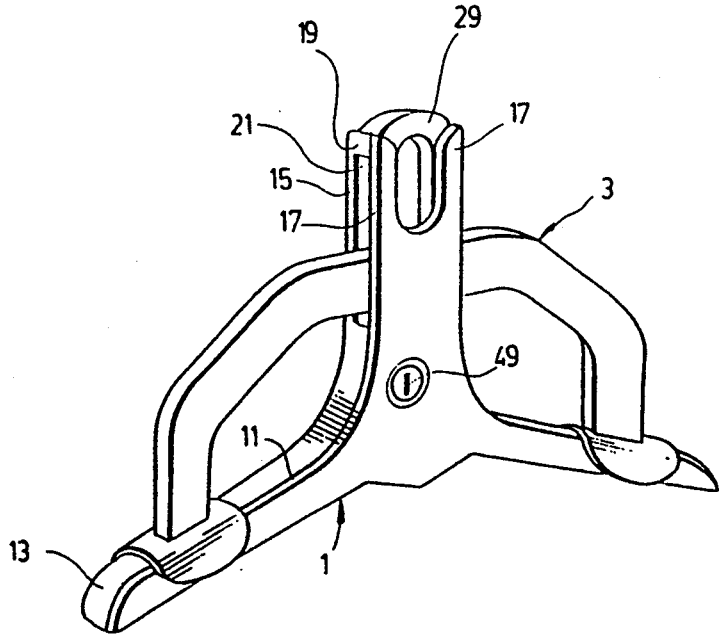
FIG. 1
FIG. 2
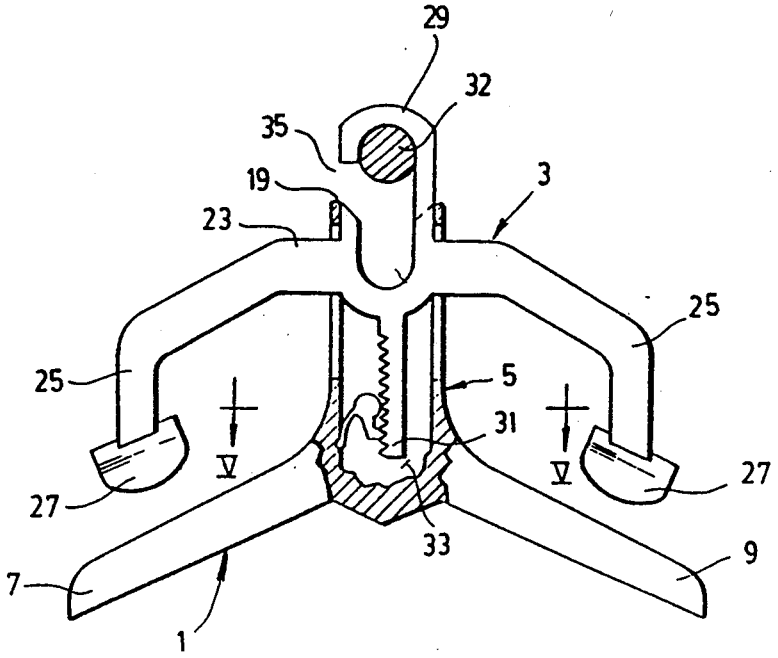

TAMPER PROOF HANGER WITH IMPROVED RATCHET ARM IN LOCK

BACKGROUND OF THE INVENTION

1. Field of the invention

The present invention relates to improvements in a tamper-proof garment hanger of the type described in U.S. Pat. No. 4,324,352 issued on Apr. 13, 1982 to Charles Goldfarb.

2. Description of the Prior Art

In U.S. Pat. No. 4,324,352, there is disclosed a hanger having a conventional yoke-shaped hanger part having two garment supporting inclined side arms stemming from a central open-top box-like casing for supporting a piece of garment. A vertically movable gripping device is provided, having an upper part curved as a hook to fit over a round support bar or the like. When the gripping device is lowered toward the hanger, the free end of the hook comes to engage the tip of an abutment leg on the casing to thereby close and lock the hook over the round support bar. The gripping device further has a lower branch formed as a rack which slides into the casing. A pair of gripping arms project from the mid-portion of the gripping device and over the inclined side arms of the hanger part. The gripping arms have gripping cups at their ends that are applied over the garment on the hanger arms when the cups are moved against the hanger arms and to the closed position of the hook. A pawl is pivotally mounted in the hanger part central casing and is biased against the rack by a spring to hold the hook in closed position.

The above patent discloses that the locking means, formed by the rack and pawl mechanism, may be actuated with a key based only by an authorized person. A mention is made of the provision of a key-operated lock cooperating with the rack and pawl mechanism, to free the gripping device, but no such lock is disclosed.

SUMMARY OF THE INVENTION

An object of the invention lies in the provision of such a key-operable combination which is very simple yet efficient in structure and is capable of cooperation with the rack within the casing for selectively holding the garment gripping member into and out of locking position and thereby moving the hook into and out of closed position.

According to the invention, this key-operable combination comprises a cylinder lock within the central casing, this lock comprising an outer lock cylinder solid with the casing and a key-operable rotary lock barrel mounted within the outer cylinder. An operating member is rotatably mounted on the outer lock cylinder, within the central casing, this operating member and the lock barrel being coupled together for allowing rotation of the operating member when the lock barrel is key-operated into rotation. A pawl radially projects from the operating member. This pawl has a free end operatively engaging the rack of the gripping member. Finally, a resilient lever is provided which radially projects from the rotary operating member and has a free end which is resiliently applied against the inner wall of the casing to press the pawl against the rack.

The distance between the casing inner wall and the rack must of course be preselected for the resilient lever to bias the pawl into the aforesaid operative engagement with the rack. Also, the pawl and the resilient lever must be oriented to prevent withdrawal of the rack from the casing thereby releasably holding the garment gripping member into locking position of the garment. This can be achieved by orienting the resilient lever to extend in a direction away from the center line of the lock cylinder with respect to the hook of the gripping member.

A description will now be given of a preferred embodiment of the invention, having reference to the appended drawings.

BRIEF DESCRIPTION OF THE DRAWINGS

FIG. 1 is a perspective view of a hanger including the improvement of the invention;

FIG. 2 is a front view with a portion broken away to show the inner structure;

DESCRIPTION OF THE PREFERRED EMBODIMENT

Figure 6:
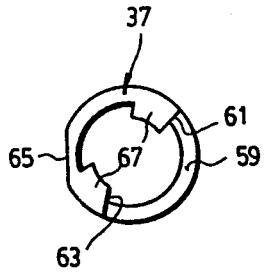
FIG. 6 is a top plan view of the lock cylinder.

The tamper-proof clothes hanger according to the invention as shown in FIGS. 1 and 2 is made up of a garment support member or part 1 and of a garment gripping member or part 3.

The support part 1 has a central casing 5 and a pair of garment support arms 7, 9 (FIG. 2) that extend laterally on either side of the lower end of the casing 5. The support part 1 is preferably made up of a front cover plate 11 and of a rear channel-shaped back plate 13 (FIG. 1) removably secured to the cover plate 11 to facilitate mounting a hook releasable holding combination described further on.

The casing 5 is provided with two pairs of limbs 15, 17 that upstand axially and that are interconnected at the top by short bridges; one such bridge and limbs acting as an abutment leg 19 and the two pairs of limbs defining an elongated channel 21.

The garment gripping part 3, as best shown in FIG. 2 has a central shoulder portion 23 which is capable of being slid across the channel 21 and from which laterally project a pair of gripping arms 25, out of the channel and thus of the casing 5. Each arm terminates with a shoulder cup 27 that may be padded. The padded cups serve to press and lock the shoulders of a coat or the like on the hanger part support arms 7, 9 when moved against them into garment locking position. A hook 29 projects from one side of the shoulder 23 while a rack 31 projects from the other side and into a chamber 33 defined by the casing 5. It will be gathered from FIGS. 1 and 2 that the free end of the hook 29 is movable into and out of engagement with the abutment leg 19. Thus, starting with FIG. 2, the hook 29 may be made to hang from a support bar 32 through the opening 35 between it and the abutment leg 19. Thereafter, if the hanger support arms 7, 9 are moved up against the padded cups 27, the opening 35 is closed and the hook 29 may not be removed from the supporting bar 32.

Finally, means operable by a key are provided within the casing chamber 33, to engage with the rack 31 and hold the gripping member 3 in garment locking position (FIG. 1) and simultaneously in closing position of the hook 29 around the bar 32. With the appropriate key for releasing the above means, the hook may be moved to open position and the jaws 27 from the support arms 7, 9 to allow freeing of the hanger from the bar 32 and removal of the garment.

The above structure is essentially the same as that disclosed in the aforesaid U.S. Pat. No. 4,324,352 which however fails to describe any releasably holding means for the rack 31 and thus for the hook 29 and garment support part 1.

Figure 5:
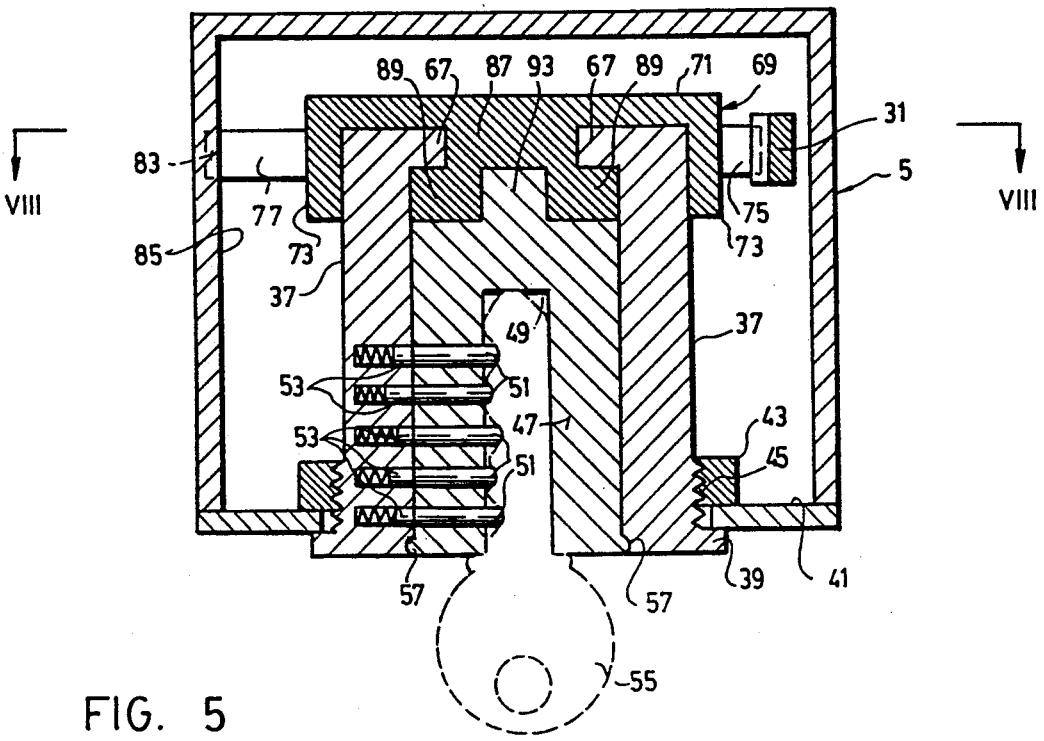
FIG. 5 is a cross-sectional view, on an enlarged scale, taken along line V—V of FIG. 2.
Figure 10:
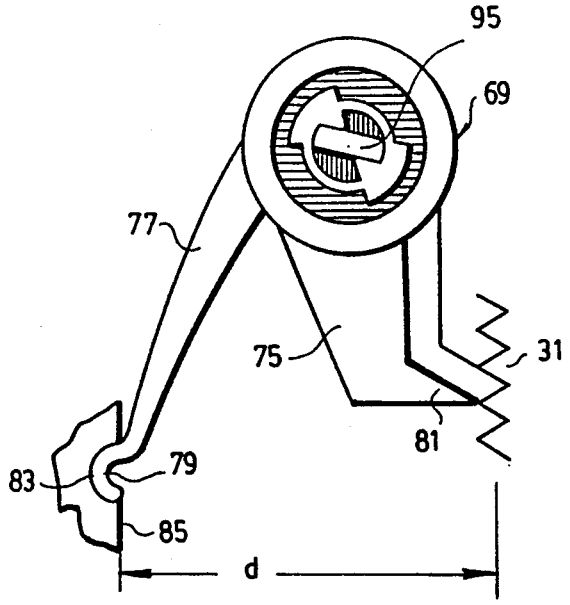
FIGS. 10, 11 and 12 are diagramatic top plan views of the lock cylinder, lock barrel and operating member in engagement with the rack and casing inner wall. shown in three different positions of the lock cylinder, lock barrel and operating member.
Figure 11:
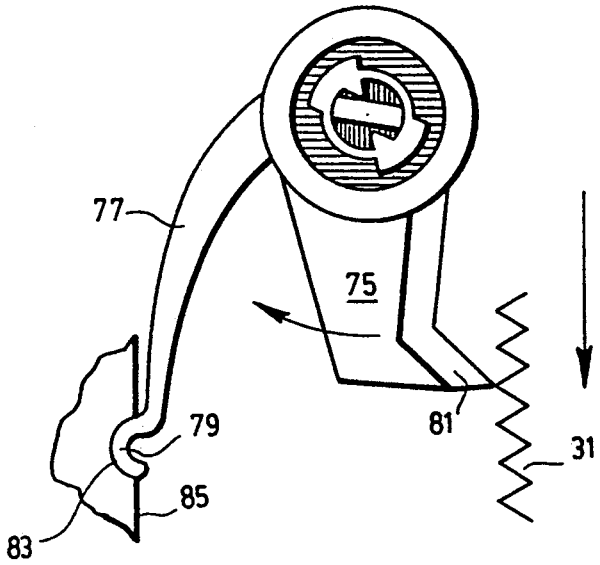

FIGS. 3 to 9 illustrate an embodiment of such means made according to the invention, which comprise a generally conventional key-operable cylinder lock having an outer lock cylinder 37 (FIGS. 3 and 6) made solid with the casing 5 (FIG. 5) by any known means such as by being formed at one end with a shoulder 39 pressed against the front inner wall 41 of the casing by a screwing ring 43 engaging a threaded portion 45 of the lock cylinder 37 and capable of forcing the shoulder 39 against the wall 41. The cylinder lock also comprises a rotary lock barrel 47, coaxially mounted within the lock cylinder 37, having a key-insertion slot 49 and a set of radial tumblers 51 adapted to be pressed by an even number of spring-biased radial pegs 53 of the lock cylinder 37. In normal use, the slot 49 stands vertical and the tumblers 51 are coaxial with the pegs 53, having been brought to an even level by the peaks and valleys of the proper key 55, as shown in FIG. 5. The lock barrel 47 is held against relative axial displacement in the bore of the lock cylinder 37 by a radial rib 57, at the key insertion end of the slot 49, the rib being forced into an appropriate V slot in the lock cylinder bore. Similarly, a tongue 50 (FIG. 3) is radially force fitted into an appropriate slot at the top of the barrel which now serves to hold it in the lock cylinder, as further detailed hereinafter.

Figure 3:
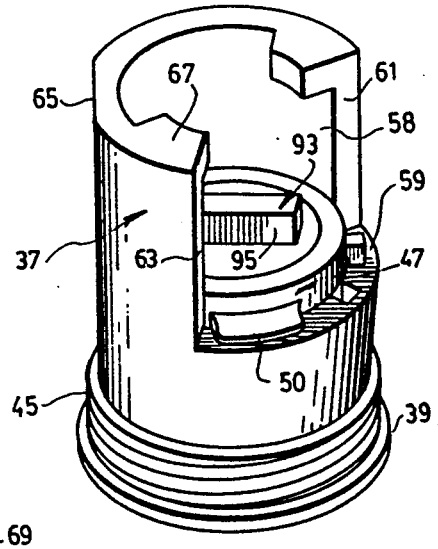
FIG. 3 is a perspective view of the lock cylinder.
Figure 7:
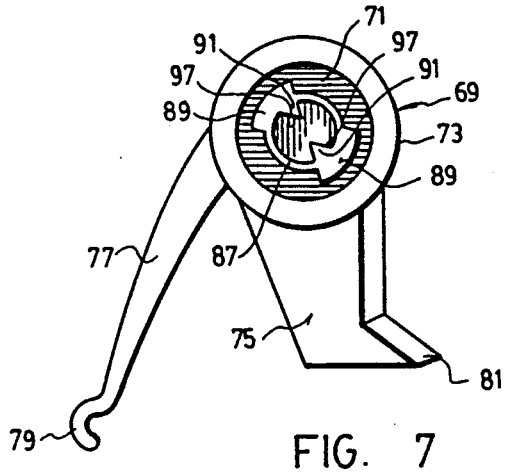
FIG. 7 is a top plan view of the operating member.

The casing inner end of the lock cylinder 37 is cut with an axial slot 58 defined by a radial face 59 and a pair of axial faces 61, 63 (FIGS. 3 and 6). The lock cylinder 37 is also formed with an axial outer flat 65 and, at its free end, with a pair of inwardly jetting radial lugs 67, diametrically opposing one another; all for a purpose to be determined hereinbelow. It will be noted (FIG. 3) that the lock barrel 47 terminates short of the free end of the lock cylinder 37, beneath the lugs 67.

Rotatably mounted over the free end of the lock cylinder 37 is an operating inverted cup-like member 69 (FIGS. 4 and 7) having a circular bottom wall 71 and a circumscribing skirt 73 around it (FIG. 5). In use, the bottom wall 71 sits over the terminal face of the lock cylinder 37 and the skirt 73 surrounds it. The cup-like member 69 is rotatably mounted over the lock cylinder 37 as seen in FIG. 5.

Projecting outwardly radially about mid-way on the skirt 73 is a pawl 75 of which the free end is angularly formed at 81 and engages between two successive teeth of the aforementioned rack 31 of the gripping member 3. For the purpose sought, the free end or tip 81 of the pawl 75 as well as the teeth of the rack 31 should be shaped, in cross section, as compatible isosceles triangles so that the pawl tip may fit snugly between two successive teeth of the rack and become automatically firmly engaged when the rack is moved into the casing chamber 33.

Also projecting radially about mid-way on the skirt 73 and angularly distant from the pawl 75, is a slightly curved lever 77 which is resilient lengthwise and which has a rounded tip 79 lodging, in use, in a receiving groove 83 in the inner wall 85 of the casing 5 (FIGS. 5, 7 and 10 to 12).

The operating key 55 is intended to rotate the lock barrel 47 which, in turn, has to cause rotation of the operating member or cup 69. Appropriate coupling means are therefore provided between the two to allow such rotation and such means are as follows.

A coupling cylinder 87 projects from the bottom wall 71 coaxially with the skirt 73 (FIG. 4) of the operating cup 69 and terminates short of its terminal transverse face. Outwardly projecting from its free end, are two radial collars 89 that diametrically oppose one another. As will be seen later, these collars 89 are intended to cooperate with the lugs 67 of the lock cylinder 37, which lugs 67 form part of the coupling means. The top of the coupling cylinder is also provided with two inwardly projecting triangular ears 91 which are located diametrically opposing one another and at opposed ends of the collars 89.

The coupling means aforesaid further include a tenon 93 extending from the free end of the lock barrel 47 (FIG. 3). It extends diametrically across its terminal face and has a rectangular shape in cross section defining two parallel driving faces 95, one only being shown in FIG. 3. It will be noted, at this time, that two faces 97 of the triangular ears 91 (FIG. 7) are disposed each on one side of a common diameter of the coupling cylinder 87, are parallel and are of a width between them that allows their engagement with the driving faces 95 of the tenon 93, as shown best in FIG. 10.

Referring to this FIG. 10 again, it will be seen also that the distance d between the casing inner wall 85 and the rack 31 is preselected for the resilient lever 72 to bias at all times, the pawl 75 into operative engagement with the rack. As shown also, and for proper efficiency, the pawl 75 and the resilient lever 77 should be oriented to prevent withdrawal of the rack 31 from the casing 5, that is the pawl and lever should be oriented to extend in a direction away from the center line of the lock cylinder 37 with respect to the hook 29 and the gripping member 3 as best appreciated from FIG. 2.

A description now follows of the manner of assemblying and operating the tamper-proof clothes hanger above described.

The front cover plate of the hanger is first removed from its back plate 13 (FIG. 1).

The lock barrel 47 is inserted into its cylinder 37 and locked therein by the tongue 50 (FIG. 3) which is driven into its slot in the lock barrel and over the radial face 59 of the slot 58 using a master key to do so. The resulting cylinder lock is then locked into position by the screwing ring 43; care being taken that the flat face 65 (FIGS. 3 and 6) stands vertical, thereby placing the radial lugs 67 in a predetermined position.

Figure 8:
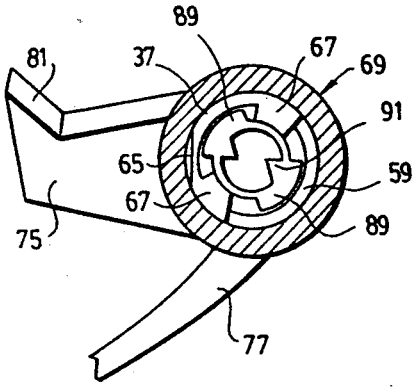
FIGS. 8 and 9 are cross-sectional views taken along line VIII—VIII of FIG. 5, showing the lock cylinder and operating member in two different relative positions.

The lock barrel 47 is then rotated with its standard, operating key until the tenon 93 is oriented between the lugs 67 at the top of the cylinder 37, as in FIG. 8.

With the tenon 93 so oriented, the operating cup member 69 is placed over the lock cylinder 37 and, if need be, rotated so that the driven faces 97 (FIG. 7) of the ears 91 fall in facing engagement with the driving side faces 95 (FIG. 3) of the tenon 93. The cylinder lock is then moved into the casing.

Figure 9:
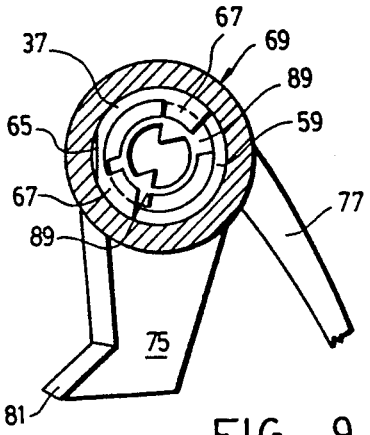
Figure 4:
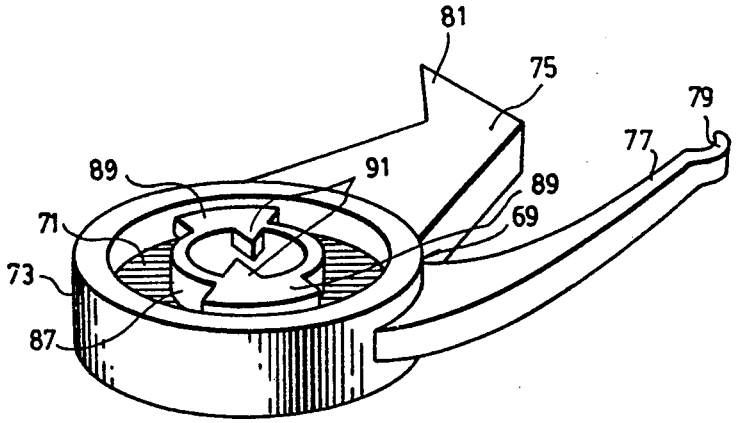
FIG. 4 is a perspective view of the operating member adapted to fit over the cylinder lock.

At that time, the rack 31 of the garment gripping part 3 (FIG. 2) is moved down into the chamber 33 of the casing 3 into engagement with the pawl 75. The distance d between the rack 31 and the wall 85 has been selected to be less than that between the tips 79 and 81 of the lever 77 and of the pawl 75, respectively as aforesaid. Inward movement of the rack therefore causes clockwise rotation of the operating cup 69 and of its pawl; insertion of the lever tip 79 into its groove 83, and stressing of the lever 77 by the continued rotation of the cup 69, by the action of the pawl 75, and as shown in FIGS. 5 and 9, sliding of the radial collars 89 beneath the radial lugs 67 so as to hold the cup-member 69 captive over the lock cylinder 67. Inward movement of the rack continues until the free end of the hook 29 reaches the tip of the abutment leg 19 (FIGS. 1 and 2).

By this time, the key slot 49 of the barrel lock 47 has reached the vertical position and the tumblers 51 become aligned with the pushing pegs 53, as in FIG. 5.

Figure 12:
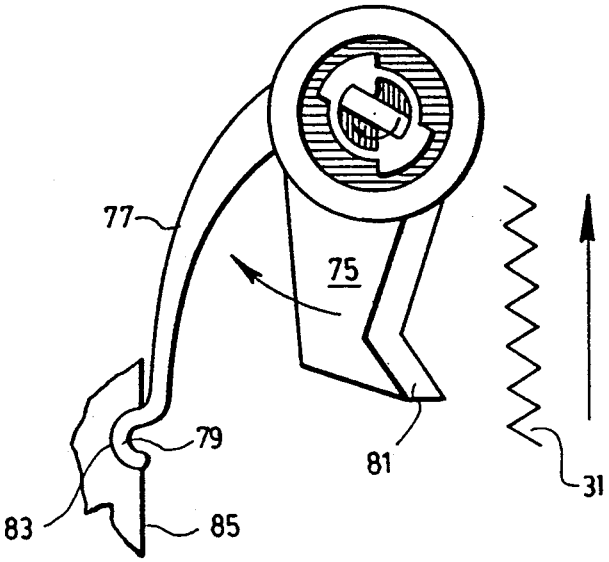

By inserting the key 55 into the slot 49 to push the tumblers 51 back in line with the pegs 53, it becomes possible to rotate the barrel lock 47 and consequently to rotate the tenon 93 and the operating cup 69 clockwise as in FIG. 12, so that the locking tooth 81 of the pawl 75 is moved away from the rack 31 and makes it possible to open up the hook 29 as in FIG. 2.

As can now be understood, the key lock combination according to the invention is very simple yet efficient in structure and operation. It comprises two pieces exclusively, namely the cylinder lock and cup-like member 69, and thus avoids the use of pivots, springs and other components not easy to assemble.

I claim:

1. A tamper-proof hanger comprising:

a garment support member having a central casing with inner walls and a pair of garment support arms extending from one end of said casing and projecting laterally on either side thereof, a garment gripping member having a central portion slidable in said central casing, axially thereof, and having a pair of gripping arms extending laterally from said central portion and out of said central casing, said gripping arms being provided at the ends thereof with means adapted for pressing and locking a garment onto said support arms when said gripping member is moved toward said garment support arms into garment locking position; said garment gripping member having a rack inserted and movable within said central casing, and means within said casing, engageable with said rack for selectively holding said gripping member into and out of said garment locking position; the improvement wherein said selectively holding means comprises;

a cylinder lock within said central casing; an outer lock cylinder solid with said casing;

a rotary lock barrel within said outer cylinder; and tumbler and peg means operatively connecting said lock cylinder and said lock barrel;

a key removably insertable in said lock barrel for rotating said lock barrel;

an operating member rotatably mounted on said outer lock cylinder within said central casing;

coupling means on said operating member and on said lock barrel for allowing rotation of said operating member when said lock barrel is key-operated into rotation;

a pawl integrally and radially projecting from said operating member and having a free end operatively engaging said rack of said gripping member;

a resilient lever integrally and radially projecting from said rotary operating member and having a free end resiliently applied against one of said inner walls of said central casing to press said pawl against said rack;

wherein the distance between said casing inner wall and said rack is preselected for said resilient lever to bias said pawl into said operative engagement with said rack;

wherein said operating member is cup-shaped, having a circular bottom wall sitting over the casing inner end of said lock cylinder, and having a cylindrical skirt surrounding said lock cylinder, said pawl and resilient lever projecting radially from said skirt;

wherein said lock barrel has a key-insertion end and an operating end within said outer lock cylinder; and wherein said coupling means comprises;

a coupling cylinder projecting from said bottom wall; coaxially therewith, and having a free end;

a pair of outwardly projecting radial collars at said free end, diametrically opposing one another;

a pair of inwardly projecting lugs at the casing inner end of said lock cylinder, diametrically opposing one another; said collars being disposed beneath said lugs for holding said operating member captive on said lock cylinder;

a pair of inwardly projecting radial ears at the free end of said coupling cylinder, diametrically opposing one another and each having a tenon-engaging face; and a tenon extending from said lock barrel and having opposing surfaces in operative engagement with said tenon engaging faces of said radial ears, constructed so that rotation of said lock barrel causes rotation of said cup-shaped operating member.

2. A hanger as claimed in claim 1, wherein said central casing inner wall is formed with a groove and said free end of said lever is made to fit into said groove.

3. A hanger as claimed in claim 1, further including means on said lock cylinder and on said lock barrel to lock them against axial displacement.

4. A hanger as claimed in claim 1, further including means operable by a master key on said lock cylinder and on said lock barrel to lock them against relative axial displacement.

* * * * *